US008365416B2

(12) United States Patent
Rockell et al.

(10) Patent No.: US 8,365,416 B2
(45) Date of Patent: Feb. 5, 2013

(54) LIQUID DISPENSING DEVICE COMPRISING A PERISTALTIC PUMP

(75) Inventors: Barry Keith Rockell, Bracknell (GB); William Owen Jolley, Spencer, MA (US); James Leo Salemme, Billerica, MA (US)

(73) Assignee: The Gillette Company, Boston, MA (US)

( * ) Notice: Subject to any disclaimer, the term of this patent is extended or adjusted under 35 U.S.C. 154(b) by 37 days.

(21) Appl. No.: 13/048,335

(22) Filed: Mar. 15, 2011

(65) Prior Publication Data

US 2011/0219623 A1 Sep. 15, 2011

Related U.S. Application Data

(60) Provisional application No. 61/340,289, filed on Mar. 15, 2010.

(51) Int. Cl.
*B26B 21/44* (2006.01)
*A46B 11/02* (2006.01)

(52) U.S. Cl. ..... 30/41; 222/101; 401/155

(58) Field of Classification Search ..... 30/41; 132/290, 132/311; 222/101; 401/147, 155
See application file for complete search history.

(56) References Cited

U.S. PATENT DOCUMENTS

| | | | | | |
|---|---|---|---|---|---|
| 1,556,437 | A | * | 10/1925 | Granger | 222/101 |
| 1,711,755 | A | * | 5/1929 | Smith | 222/101 |
| 2,543,667 | A | * | 2/1951 | Palmer | 222/101 |
| 2,570,755 | A | * | 10/1951 | Booth | 222/96 |
| 3,263,862 | A | * | 8/1966 | Tazzeo | 222/101 |
| 4,019,655 | A | * | 4/1977 | Moeller | 222/96 |
| 4,025,241 | A | | 5/1977 | Clemens | |
| 4,653,188 | A | | 3/1987 | Kwak | |
| 4,753,006 | A | | 6/1988 | Howe | |
| 5,070,611 | A | | 12/1991 | Derin et al. | |
| 5,098,261 | A | | 3/1992 | Bertoncini | |
| 5,203,473 | A | * | 4/1993 | Willey | 222/94 |
| 5,337,478 | A | * | 8/1994 | Cohen et al. | 30/41.5 |
| 5,458,563 | A | | 10/1995 | Stewart | |
| 5,701,674 | A | | 12/1997 | Mitchell | |
| 5,868,282 | A | * | 2/1999 | Imhoff | 222/101 |

(Continued)

FOREIGN PATENT DOCUMENTS

| | | |
|---|---|---|
| EP | 0 238 333 A1 | 9/1987 |
| GB | 2 270 300 A | 9/1994 |

(Continued)

OTHER PUBLICATIONS

PCT International Search Report with Written Opinion in corresponding Int'l appln. PCT/US2011/028504 dated Jun. 20, 2011.

(Continued)

*Primary Examiner* — Hwei C Payer
(74) *Attorney, Agent, or Firm* — Ronald T. Sia; Kevin C. Johnson; Steven W. Miller

(57) ABSTRACT

The invention features a hand held device that dispenses fluid during operation. The hand held device includes a handle and a device head operably engaged thereto. The handle has a proximal end forming a product dispensing aperture, a distal end forming a cavity for housing a fluid, a supply channel in fluid communication with the cavity and the product dispensing aperture, a peristaltic pump physically engaged with the supply channel, and a flexible barrier that rests between the peristaltic pump and the supply channel preventing direct contact of the supply channel by the peristaltic pump. Actuation of the peristaltic pump displaces fluid from the cavity to the product dispensing aperture.

13 Claims, 3 Drawing Sheets

U.S. PATENT DOCUMENTS

| | | | | |
|---|---|---|---|---|
| 5,918,995 | A | 7/1999 | Puurunen | |
| 5,983,500 | A | 11/1999 | Da Silva | |
| 6,196,420 | B1 * | 3/2001 | Gutierrez et al. | 222/101 |
| 6,401,978 | B1 * | 6/2002 | Young | 222/101 |
| 6,789,321 | B2 | 9/2004 | Simms | |
| 6,789,703 | B2 * | 9/2004 | Pierre-Louis | 222/101 |
| 7,127,817 | B2 | 10/2006 | Orloff et al. | |
| 7,200,936 | B2 * | 4/2007 | Coffin et al. | 30/41 |
| 7,699,552 | B2 | 4/2010 | Grez et al. | |
| 7,788,810 | B2 | 9/2010 | Noble | |
| 7,814,661 | B2 | 10/2010 | Tomassetti | |
| 2003/0098316 | A1 * | 5/2003 | Bochno et al. | 222/101 |
| 2005/0144785 | A1 | 7/2005 | Bressler et al. | |
| 2006/0272154 | A1 | 12/2006 | Brevard | |
| 2006/0289031 | A1 | 12/2006 | Grez et al. | |
| 2008/0003048 | A1 | 1/2008 | Glassman et al. | |
| 2008/0016692 | A1 | 1/2008 | Noble | |
| 2008/0216322 | A1 | 9/2008 | Molema et al. | |
| 2008/0307660 | A1 * | 12/2008 | Clarke | 30/535 |
| 2009/0183371 | A1 | 7/2009 | Mileti et al. | |
| 2009/0211099 | A1 | 8/2009 | Louis | |
| 2009/0235530 | A1 | 9/2009 | Tomassetti | |

FOREIGN PATENT DOCUMENTS

| | | | |
|---|---|---|---|
| WO | WO 94/19252 | * | 9/1994 |
| WO | WO-2007/146974 A2 | | 12/2007 |

OTHER PUBLICATIONS

U.S. Appl. No. 13/048,247, filed Mar. 15, 2011, William Owen Jolley, et al.

U.S. Appl. No. 13/048,359, filed Mar. 15, 2011, Barry Keith Rockell, et al.

* cited by examiner

LIQUID DISPENSING DEVICE COMPRISING A PERISTALTIC PUMP

CROSS REFERENCE TO RELATED APPLICATIONS

This application claims the benefit of U.S. Provisional Application No. 61/340,289 filed Mar. 15, 2010.

BACKGROUND OF THE INVENTION

Hand held liquid dispensing devices, such as razors and toothbrushes, are known. For example, razors that dispense liquid have been disclosed in U.S. Pat. No. 4,653,188, U.S. Pat. Nos. 5,701,674 and 5,070,611, and U.S. Applications 2009/0235530, 2009/0211099, 2009/0183371, 2008/0216322, and 2006/0272154. Disclosed in these and other publications are various wet shaving product configurations that include systems for conveying a shaving preparation during shaving, e.g., a lubricating fluid, from a reservoir incorporated in the razor structure in the form of a hollowed out razor handle or even an aerosol can that acts as a razor handle, to a dispensing location near the head of the razor. A number of more recent wet shaving razors have cartridges that are moveably mounted, in particular, pivotable, relative to the handle structures on which they are mounted either permanently, in the case of disposable safety razors intended to be discarded when the blade or blades have become dulled, or detachably to allow replacement of the blade unit on a reusable handle structure. Exemplary razors of this sort are disclosed in U.S. Pat. Nos. 6,789,321 and 7,127,817. Exemplary toothbrushes having pumps are disclosed in U.S. Pat. Nos. 5,918,995, 5,458,563, and 7,699,552.

Additionally, the use of movable actuators to dispense liquid from the razor is known. Examples of razors utilizing peristaltic pumps are disclosed in U.S. Applications 2006/0289031 and 2008/0016692. However, many of these wet razors that dispense liquid during use are awkward to operate and cumbersome to hold because of the size and shape needed to accommodate a peristaltic pump. Some of these devices require the mechanism for dispensing the liquid to be reset after every operation of the device. Moreover, some even require multiple parts and electrical power from a wall outlet, limiting the portability of the hand held device. Furthermore, with multiple parts, when stored and during operation, these hand held devices occupy valuable space in bathrooms that are typically limited in size. Additionally, most peristaltic pumps contain a rotor with rollers attached thereto. Smaller peristaltic pumps, however, requires nodes or nubs on a rotor, rather than rollers, like those disclosed in U.S. Pat. Nos. 5,098,261 and 4,025,241, and GB 2,270,300. When rotated, the nodes or nubs tend to pull and/or tug on the tube transporting the liquid. This pulling and tugging by the smaller peristaltic pumps is believed to cause displacement of the tube, as well as wear and tear on the material of the tube, ultimately reducing the life of the device. Exemplary toothbrushes having pumps are disclosed in U.S. Pat. Nos. 5,918,995, 5,458,563, and 7,699,552.

A need therefore exists to provide a razor that overcomes one or more of the aforementioned problems.

SUMMARY OF THE INVENTION

One aspect of the present invention provides a hand held device for dispensing a liquid upon actuation by the user. The device can be a hand held device such as a liquid dispensing razor or can be a dispensing toothbrush or other personal car product. The hand held device comprises a handle and a device head that is operably connected to the handle. Where the device is a hair removal device, it can be by shaving with a razor or other hair removal technology, such as depilatories. The handle comprises a proximal end that forms a product dispensing aperture and a distal end, opposite of the proximal end, that forms a cavity for housing a fluid disposed within the handle. The product dispensing aperture in the proximal end of the handle is in fluid communication with the cavity in the distal end of the handle via a supply channel. Additionally, a peristaltic pump is positioned between the proximal end and the distal end of the handle. The peristaltic pump comprises a rotating actuator that is physically engaged with the supply channel and configured to transport fluid from the vicinity of the cavity to the product dispensing aperture when triggered. The device of the present invention comprises a flexible barrier between the rotating actuator and the supply channel, allowing the rotating actuator to indirectly engage the supply channel.

In another embodiment, the actuator is equipped with a ratchet system, limiting the actuator has a unidirectional rotation, allowing only fluid to move out of the cavity and through the aperture. In another embodiment, the rotating actuator on the peristaltic pump comprises at least two nodes. At least one of these at least two nodes is in contact with the supply channel forming a pinch point. At least one of the nodes forms a pinch point with the supply channel throughout the rotation of the rotating actuator.

In yet another embodiment, the invention features a rotating actuator with a central axis and a maximum radial movement of up to about 15 mm. In one embodiment, the device further comprises a channel in the handle, allowing for the movement of the rotating actuator within the channel. Furthermore, a notch may be located along the channel, indicating the central axis of the peristaltic pump. Additionally, a spring may be attached to the peristaltic pump allowing it to return to its central axis after it has been moved within the channel.

Other features and advantages of the invention will be apparent from the description and drawings, and from the claims. Methods of using said device are also provided.

DETAILED DESCRIPTION OF THE INVENTION

Figure 1:
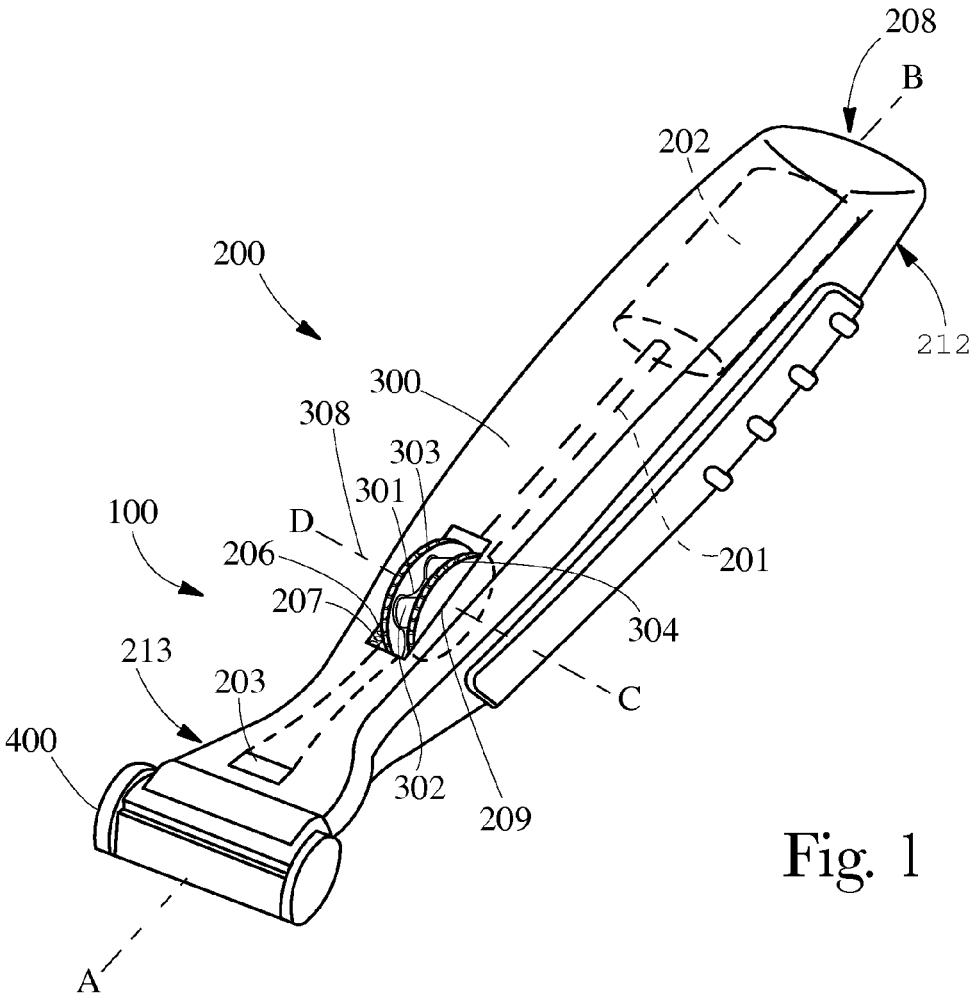
FIG. 1 is a perspective view of a hand held device of the present invention.
Figure 4:
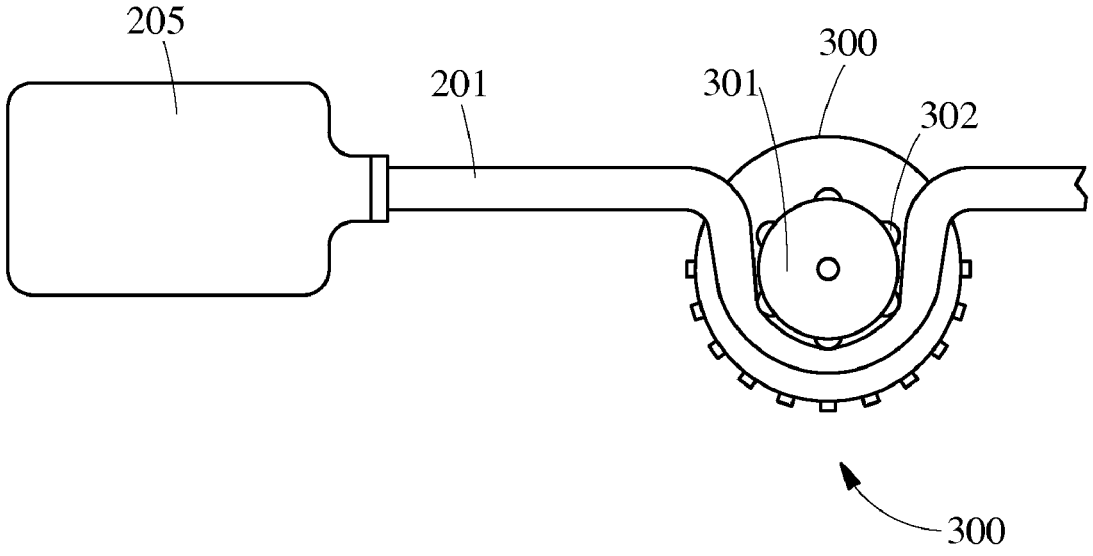
FIG. 4 is an exploded view of one embodiment of the peristaltic pump and supply channel.
Figure 5:
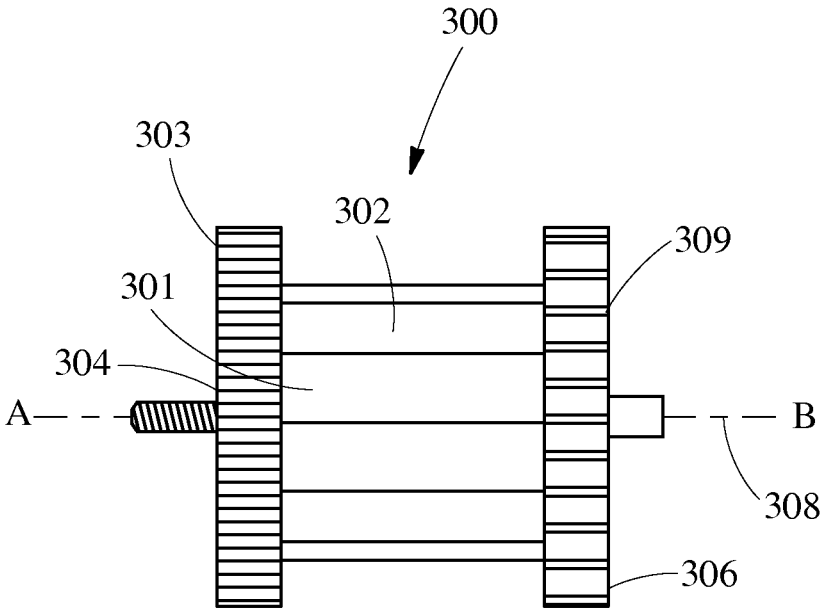
FIG. 5 is a frontal view of one embodiment of the peristaltic pump.
Figure 6:
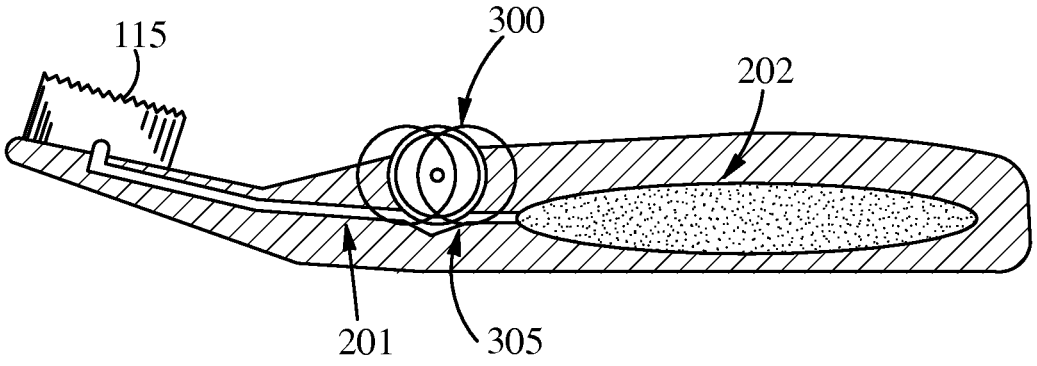
FIG. 6 is a side view of another embodiment where the device is a dispensing toothbrush.

FIGS. 1-6 show a hand held device (100) capable of dispensing fluid during the hair removal process (such as shaving), comprising, a peristaltic pump (300), and a device head (400). The device head (400) may be a shaving cartridge, which includes a guard and an elastomeric member disposed on the guard, or a scraping surface. Nonlimiting examples of suitable device heads are disclosed in U.S. Pat. Nos. 7,197, 825, 6,298,558, 6,161,288. FIG. 1 shows a head which is a razor head (100). FIG. 6 shows a head which is a toothbrush head (115).

FIG. 1 provides a perspective view of the hand held device (100). The handle (200) has a proximal end (213) and a distal end (212) and is adapted to hold a device head (400). The device head (400) may be permanently affixed on handle (200), or may be releasably engaged from the handle (200). Nonlimiting examples of suitable handles are disclosed in U.S. Pat. D533,684, U.S. Pat. No. 5,918,369, and U.S. Pat. No. 7,168,173. This disengagement of these two components allows for replacement of razor cartridges as the continued use of such cartridges causes blade dulling. Thus, such cartridges are replaceable and disposable at will by the user.

As shown in FIG. 1, the handle (200) comprises a cavity (202) for housing a fluid disposed within the distal end (212) of the handle (200) and a product dispensing aperture (203) formed within the proximal end (213) of the handle (200). The cavity (202) and the product dispensing aperture (203) are in fluid communication with each other via a supply channel (201). The supply channel (201) is configured to transport fluid out of the cavity (202) and through the product dispensing aperture (203). Furthermore, the handle (200) contains a peristaltic pump (300) located along the handle between the distal end (212) and the proximal end (213) and physically engaged with the supply channel (201). Actuation of the peristaltic pump (300) displaces fluid from the cavity (202) through the supply channel (201), and eventually through the product dispensing aperture (203).

The cavity (202), or a removable pouch/container (205) within the cavity (202) as shown in FIG. 4, contains the fluid to be dispensed during hair removal. In an embodiment, the fluid in the cavity (202) or removable pouch (205) is refillable or replaceable. The removable pouch (205) may have multiple chambers that allow fluids to mix upon being dispensed. The fluid may include shaving gels, shaving foams, shaving lotions, skin treatment compositions, conditioning aids, depilatories, lotions, moisturizers, etc., all which may be used to prepare the skin's surface prior to the engagement of the device head with the skin or even after engagement of the device head with the skin. Additionally, such materials may comprise benefit agents suitable for skin and/or hair that may be useful for a number of different desirable effects including exfoliation, cooling effects, cleansing, moisturizing, warming or thermogenic effects, conditioning, and the like. Nonlimiting examples of suitable benefit agents for skin and/or hair for inclusion into the fluid of the razor are disclosed in U.S. Pat. No. 6,789,321. For instance, suitable agents include but are not limited to shaving soaps, lubricants, skin conditioners, skin moisturizers, hair softeners, hair conditioners, fragrances, skin cleansers, bacterial or medical lotions, blood coagulants, anti-inflammatories, astringents, and combinations thereof. In certain embodiments, such as that shown in FIG. 4, the fluid may be contained in a removable pouch (205), either disposable or reusable, that is further contained within the cavity (202) of the handle (200).

Figure 2:
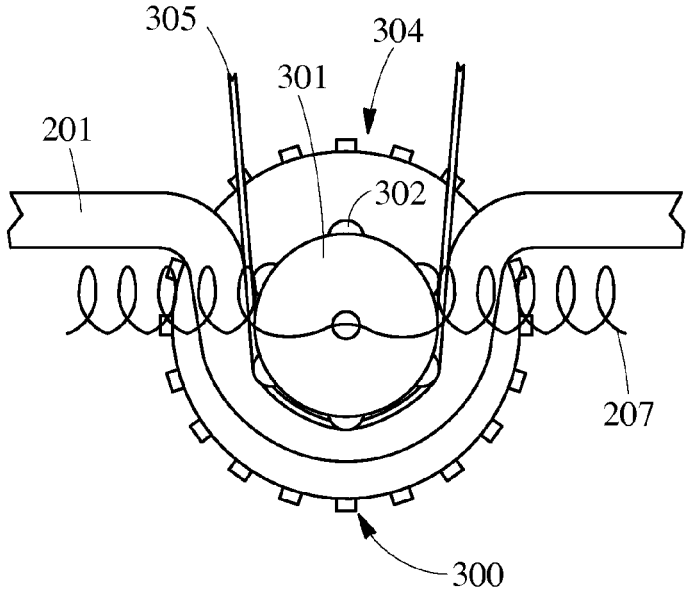
FIG. 2 is a side view of one embodiment of the peristaltic pump.

FIG. 2 provides a side view of one embodiment of the peristaltic pump (300). The peristaltic pump (300) comprises a rotating actuator (301), such as a wheel, nodes (302), such as nubs, disposed on the actuator (301), and is rotatably engaged with the supply channel (201). The peristaltic pump (300) activates fluid flow from the cavity (202) through the supply channel (201), and out the product dispensing aperture (203) by means of peristalsis. Without intending to be bound by theory, it is believed that peristalsis is the consecutive contraction of the walls of a tube-like structure, causing the contents within the tube-like structure to displace through the tube-like structure. The rotating actuator (301) utilizes nodes (302) instead of pump rollers, like those disclosed in U.S. Pat. Nos. 5,098,261 and 4,025,241, and U.K. Application GB 2,270,300, to contract the walls of the supply channel (201) and move the volume of fluid up to the product dispensing aperture (203). Furthermore, it is believed that by minimizing the amount of movable parts, the peristaltic pump (300) has less of a chance of malfunctioning from a broken part. When the actuator (301) rotates, the nodes (302) attached to the actuator (301) rotate with the actuator (301), contacting the supply channel (201) by pinching the supply channel (201), creating a pinch point as shown in FIG. 2. As the actuator (301) continues to rotate, the pinch point travels along the supply channel (201) in the direction of rotation. The combination of the node (302) and the pinch point directs any fluid in the supply channel (201) through the supply channel (201), while simultaneously allowing fluid to enter the supply channel (201) from the cavity (202). The directed fluid flows through the supply channel (201) in the direction of rotation of the rotating actuator (301) and nodes (302). Furthermore, the pinch point serves a dual purpose. While it directs fluid through the supply channel (201) and out the product dispensing aperture (203), the pinch point additionally serves as a shut off valve for the cavity (202). Acting as a shut off valve, the pinch point minimizes or prevents contaminated fluid from re-entering the cavity (202), or moving back in the flow path. Once fluid becomes exposed to the outer environment, it poses a risk of becoming contaminated with debris and bacteria. Allowing contaminated fluid into the cavity of the handle could potentially contaminate the remaining fluid in the cavity (202), aiding microbial growth in both the cavity (202) and supply channel (201).

Furthermore, as shown in FIGS. 2 and 5, a contact wheel (303) may be rotatably attached to the actuator (301), allowing a user to manually turn the actuator (301) with the motion of a finger. The contact wheel may contain textured surface (304) allowing easy grip and a comfortable texture for the user. The textured surface (304) on the contact wheel (303) may resemble the grooves on a quarter, or may be spaced farther apart. In most instances, the peristaltic pump (300) may be actuated by the pressure exerted by a user's finger on the contact wheel (303) such that the user may easily determine the requisite amount of fluid for one operation of the hand held device (100). Because the rotating actuator (301) contains at least two nodes (302), and when rotated, the nodes (302) push sections of fluid through the supply channel (201), the fluid can be consistently dispensed in controlled and metered quantities based on the amount of rotation of the rotating actuator (301).

Additionally, the contact wheel (303), along with the actuator (301) may be positioned to have various axes of rotation. In one embodiment, the contact wheel (303) and the actuator (301) rotate around an axis substantially parallel to the proximal-distal axis (208) of the handle (200), within about 0 to 30 degrees from parallel of the proximal-distal axis (208) of the handle (200). In another embodiment, as shown in FIG. 1, the contact wheel (303) and the actuator (301) rotate around an axis substantially perpendicular to the proximal-distal axis (208) of the handle (200), within about 0 to 30 degrees from perpendicular to the proximal distal axis (208) of the handle (200). The different rotatable axes may allow flexibility in what is more comfortable to the user. The rotation of the contact wheel (303) and the rotating actuator (301) around the substantially parallel axis enables the user to actuate the peristaltic pump (300) by moving their thumb, or other fingers, across the width of the handle (200). Furthermore, the rotation of the contact wheel (303) and the rotating actuator (301) around the substantially perpendicular axis enables the user to actuate the peristaltic pump (300) by moving their thumb, or other fingers down the length of the handle (200). Users may find the motion of moving their thumb, or other fingers, across the width of the handle (200) more natural than swiping their thumb, or other fingers, down the length of the handle (200).

In an embodiment shown in FIG. 2 of the side view of the peristaltic pump (300), a flexible barrier (305) may exist between the supply channel (201) and the actuator (301). The flexible barrier (305) can minimize or prevent the nodes (302) from tugging, pulling, and/or stretching on the supply channel (201), keeping the supply channel (201) in the same location and minimizing or preventing wear on the material of the supply channel (201). In one embodiment, the peristaltic pump (300) contains nodes/nubs (302) along the rotating actuator (301). Because these nodes (302) are stationary, and do not rotate independently of the rotating actuator (301) as pump rollers would, the nodes (302) are pressed into and dragged across the supply channel (201) to produce a peristalsis effect. The dragging of stationary nodes (302) is believed to create a potentially undesirable amount of friction between the nodes (302) and the supply channel (201). It is believed that this amount of friction may have wear and tear effects on the supply channel (201).

Without intending to be bound by theory, it is believed that the addition of the flexible barrier can extend the life of the device by minimizing wear and tear on the internal parts which would be in direct contact with the nodes. Further, the barrier allows the device to be more accommodating to various types of users, such as those who push down with a great amount of force on the rotating actuator. Additionally, the flexible barrier may act as a cushioning member to spread out the force applied by each node onto the supply channel. This can allow the force to be more evenly distributed across the supply channel to push a more consistent amount of composition along.

One possible effect on the supply channel (201) is the eventual deformation of the supply channel (201) material, potentially wearing down the supply channel (201) prematurely. A second possible effect on the supply channel (201) is pulling or tugging of the supply channel (201) by the nodes (302). This is believed to cause the supply channel (201) to reposition within the handle (200), having many potentially undesirable consequences on the hand held device (100). One potential consequence includes the repositioning the supply channel (201) to where it becomes disengaged with the rotating actuator (301), minimizing or preventing the nodes (302) from forming a pinch point. If this were to occur, the nodes (302) would not be to direct fluid through the supply channel (201). Another potential outcome from the supply channel (201) repositioning due to friction with the nodes (302) would be disconnection of the supply channel (201) from the either the cavity (202) or the product dispensing aperture (203). If the supply channel (201) disconnected from either of these two elements, the performance of hand held device (100) could be hindered.

Additionally, the flexible barrier (305), shown in FIG. 2, may be made of a deformable thermoplastic material, a metal, a glass cloth or tape material, or a combination thereof, allowing deformation of the barrier (305) by the nodes (302), which in turn, allow the nodes (302) to indirectly create a pinch point in the supply channel (201). Examples of suitable thermoplastic materials include any thermoplastic material capable of being formed into a thin sheet, such as one or more of: polypropylene, polybutylene, polystyrene, polytetrafluoroethylene (PTFE), polybutylene terephthalate, polyethylene terephthalate, polyvinyl chloride, and mixtures thereof, preferably polytetrafluoroethylene and/or polyethylene terephthalate. Suitable metals include anything that can be made into a thin sheet, such as tin, aluminum, steel, copper, brass, gold, silver, and so forth. In one embodiment, the material used in the node is not the same as the material used for the barrier. For example, the node can have a metal material and the barrier can be a thermoplastic, or vice versa. Without intending to be bound by theory, it is believed that this can be preferred because using the same material can result in the materials becoming fused or friction welded to each other. Using different materials is believed to help avoid such problems. Because the barrier (305) is in direct contact with the rotating nodes (302), the flexible barrier (305) should be made of low friction materials, such as PTFE In one embodiment, the barrier material comprises a composite of PTFE and glass cloth or tape, such as coating the glass with PTFE. Without intending to be bound by theory, it is believed that the PTFE coated glass is preferred because of its strength and flexibility PTFE coated glass cloth/tape. One example of a commercially available version of this material is PTFE Coated Glass Cloth/Teflon Tape from PAR Group out of the UK. It is believed that PTFE coated glass cloth or Teflon Tape combines the properties of PTFE/Teflon with the mechanical strength of glass cloth. It has a good heat and chemical resistance along with excellent non stick properties. It is available in plain or self adhesive backed and as anti static if required. This material is believed to withstand temperatures between −190° C. to +260° C. Further, the PTFE coated glass can have a thickness such as from about 0.07 mm to about 0.5 mm, or from about 0.1 mm to about 0.25 mm, or from about 0.15 mm to about 0.2 mm, ±0.005 mm. This material can also be used along with other materials to form a layered barrier of the overall thickness described below.

Where the barrier material comprises a thermoplastic material (such as PTFE or the PTFE coated glass) as the portion of the barrier forming the node contacting surface, an acceptable static coefficient of friction between polished steel and the material used to form the node contacting surface of the flexible material may be less than 0.3, while an acceptable dynamic coefficient of friction ("CoF") may be less than 0.45, or less than the static friction. Those of skill in the art will understand that dynamic CoF is also referred to as kinetic CoF. In one embodiment, the static and/or dynamic coefficient of friction for the flexible barrier (305) may be in the range of about 0.05 to 0.30, preferably from about 0.10 to about 0.20. Those of skill in the art will understand that static friction is friction between two solid objects that are not moving relative to each other, and dynamic friction occurs when two objects are moving relative to each other and rub together (like a sled on the ground. The static and dynamic CoF for the material used to form the node contacting surface of the barrier material can be determined in accordance with ASTM D3702, here the sample specimen is mated against a steel thrust washer. The test apparatus is rotated and the torque required is measured. Those of skill in the art will understand that if a metal barrier is used, the nodes can have one of the above described low friction thermoplastic materials in the portion of the node which contacts the flexible barrier. In such an embodiment, the thermoplastic material used to form the node can have a CoF as herein described.

In one embodiment, one or both sides of the barrier material can be polished to form a smooth surface to make the barrier and node have even less friction, preferably it is the surface which contacts the nodes. The other surface of the barrier (which contacts the supply channel can similarly be polished but could also be left rough or have texture added to it. One benefit of adding texture to the surface contacting the supply channel is that it decreases the ability of either the barrier or supply channel to get displaced or dragged relative to one another. In one embodiment, the flexible barrier comprises a rotating actuator or node contacting surface comprising thermoplastic material or metal having the static and/or dynamic CoF as described above, and a supply channel contacting surface which can also be made of a thermoplastic material and/or a metal but have a higher CoF than the rotating actuator/node contacting surface. The two surfaces can be made by a two layer flexible barrier, or a barrier made of many layers. Although the layers can be made of different materials, they can also be made of the same material.

An acceptable thickness of the flexible barrier (305) may be between about 0.07 mm to about 1.5 mm, or about 0.15 mm and 1.2 mm, or may be between about 0.5 mm and 1.0 mm±0.005 mm. A thickness within this range of most thermoplastic materials may provide an appropriate amount of deformation for the node (302) of the rotating actuator (301) to indirectly create a pinch point in the supply channel (201). If the flexible material is too thick, proper deformation may not occur, resulting in a loss of the peristalsis effect in the supply channel (201). Moreover, a flexible barrier (305) too thin may not guard the supply channel (201) from the flexible barrier's designed beneficial effects. The barrier can also be thinner or thicker depending upon the flexibility and resiliency of the materials used.

In one embodiment, the flexible barrier comprises a material having a relatively low stiffness to allow it to flex and deform when contacted by the rotating actuator and/or node (s) such that the supply channel can similarly flex and deform moving a volume of the composition towards the dispensing location. In one embodiment, the material or materials used to form the flexible barrier has a Young's modulus of from about 0.01 GPa to about 200 GPa, preferably from about 0.1 GPa to about 100 GPa, more preferably from about 1 GPa to about 70 GPa. Those of skill in the art will understand that stiffness is an extensive material property which can be impacted by the proportion of the sample, whereas young's modulus is an intensive or bulk property which does not depend on the size or volume of material in the sample. Further, although the barrier can be made of multiple layers consisting of one or more different materials, it is preferable that the entire barrier be flexible so a force applied by the rotating actuator and/or node can be transferred through the flexible barrier to create the pinch point on the supply conduit.

Further, without intending to be bound by theory, it is believed that without the flexible barrier, the rotating actuator can have an inconsistent feel when rotating (possibly caused by the movement of the nodes over the supply conduit. This can cause the rotating actuator to feel notchy. Without intending to be bound by theory, it is believed that the friction barrier smoothes out the action of the rotating actuator making it feel a more efficient pumping action.

Figure 3:
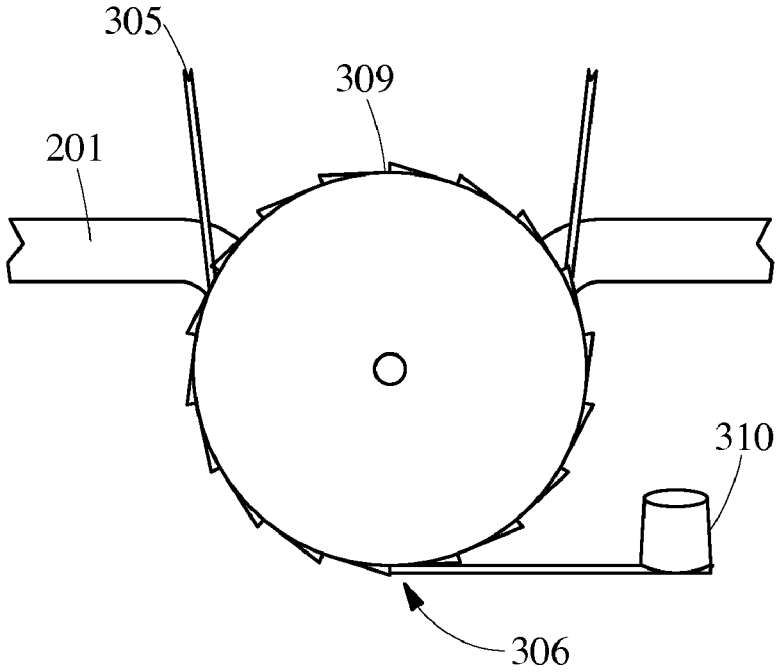
FIG. 3 is a side view of another embodiment of the peristaltic pump.

In another embodiment, the device comprises a ratchet mechanism (306), which reduces the rotation of the actuator (301) to unidirectional rotation. FIG. 3 shows a side view of an embodiment of the peristaltic pump (300) with a ratchet mechanism (306). Those of ordinary skill in the art will understand that, in embodiments where the actuator rotates (301) about an axis is perpendicular to the proximal-distal axis (208) of the handle, the direction of the rotation can be clockwise towards the razor head or counter clockwise away from the razor head. In embodiments where the actuator (301) rotates about an axis is parallel to the proximal-distal axis (208) of the handle (200), the direction of rotation can be clockwise to the right of the handle (200) or counter clockwise to the left of the handle (200). The ratchet mechanism (306) shown in FIG. 3 may use the contact wheel's textured surface (304) to minimize or prevent the actuator (301) from rotating in a direction that would pump fluid into the cavity (202). Multiple uses of the textured surface (304) minimizes the amount of parts in the hand held device (100). However, the ratchet grooves (309) may be recessed below the textured surface (304) of the contact wheel (303) to provide more comfort to the user. Using the textured surface (304) as part of the ratchet mechanism (306) may be unpleasant to the user because of the drastic groove angles with respect to the circumferential surface of the contact wheel (303). Furthermore, while the textured surface (304) may still be comfortable to the user upon first use of the hand held device (100), the textured surface (304) may wear down over time from the ratchet mechanism to become unpleasant feeling to the user. Therefore, in one embodiment the peristaltic pump comprises separate ratchet mechanism grooves (309) and textured surface (304), like that shown in FIG. 5. FIG. 3 shows a securing member (310), which secures the ratchet mechanism (306) in place during rotation of the actuator (301). The ratchet mechanism (306) may constrain the actuator (301) to rotate in a direction that would dispense fluid from the cavity (202), through the supply channel (201), and out the product dispensing aperture (203).

FIG. 1 shows yet another embodiment, where the peristaltic pump (300) may have radial movement along the length of the handle (200) of up to about 15 mm, 10 mm, 5 mm, or 0 mm. This radial movement allows the peristaltic pump (300), including the contact wheel (303), to move with the user's finger when triggered. During this radial movement, the rotating actuator (301) of the peristaltic pump (300) stays in constant contact with the supply channel (201) and/or flexible barrier (305) because of the configuration and flexibility of the supply channel (201) and/or flexible barrier (305). The radial movement provides the user with more control over the peristaltic pump (300) because the contact wheel (303) travels with the user's finger when actuated. This results in less actuation by the user to achieve the desired amount of fluid from the hand held device (100). Additionally, the radial movement of the peristaltic pump (300) may provide more control to the user. Furthermore, the handle may have a channel (206), as shown in FIG. 1, guiding the movement of the peristaltic pump (300) when the peristaltic pump (300) is actuated. The peristaltic pump (300) may have a central axis (308) along the channel, providing a resting position for the peristaltic pump (300) when not actuated. The channel (206) may be equipped with a notch (209) serving as the peristaltic pump's central axis (308), which the peristaltic pump (300) lays when not actuated. Additionally, the channel (206) may also be equipped with one or more springs (207) that return the peristaltic pump (300) to the central axis (308). Because users often shave early in the morning or late at night, when there is little light and when they may not be fully awake, the central axis (308) enables the user to easily find the contact wheel (303) without looking when picking up the hand held device (100).

The invention may further contain a nozzle attached to the product dispensing aperture (203) for dispensing the fluid onto a variety of surfaces. These various surfaces may include the guard of a shaving cartridge, the skin of the user, or a combination of the two. The nozzle may extend from the product dispensing aperture (203) to the guard of a shaving cartridge and be shaped for equal distribution of the fluid onto the guard. Moreover, the handle may further include a closure that allows access to the cavity (202) for cleaning and refilling with the fluid, or removing a sachet or pouch (205). The closure may be a cap that screws onto the handle (200), a cap that slidably engages with the handle (200), or a panel that opens on the handle (200). Furthermore, the peristaltic pump (300) may be electrically actuated rather than manually actuated. The handle (200) may contain a small electric motor connected to the peristaltic pump (300) described above. The user may simply turn the electric motor on and off to control the amount of fluid pumped from the cavity (202) during operation of the hand held device (100). The electric motor enables the user to dispense fluid during operation of the hand held device (100) with minimal effort compared to the manual actuation of the peristaltic pump (300).

A method for using the hand held device (100) comprises actuating the peristaltic pump (300) to dispense fluid from the cavity (202) through the product dispensing aperture (203), dispensing fluid onto a surface for hair removal, and removing hair from the surface via the hand held device (100).

FIG. 6 shows an embodiment where the device head is a brush head (115), such as a toothbrush or any other brush suitable for use on a hand held device. In one embodiment, fluid can be dispensed into the brush head. Fluid can also be dispensed outside of the brush head, such as closer to the handle or further away from the handle. Peristaltic pump (300) is shown in double lines with a central axis shown therein. The peristaltic pump in this figure can move radially along the length of the handle such as toward the brush head (115) or back towards the reservoir (202). These positions are shown in dashed lines. Further, the device is shown having a flexible barrier (305) positioned between the peristaltic pump and the supply channel (201).

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the DETAILED DESCRIPTION OF THE INVENTION are, in the relevant part, incorporated herein by reference; the citation of any document is not to be construed as an admission that it is prior art with respect to the present invention. To the extent that any meaning or definition of a term or in this written document conflicts with any meaning or definition in a document incorporated by reference, the meaning or definition assigned to the term in this written document shall govern.

Except as otherwise noted, the articles "a," "an," and "the" mean "one or more."

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A hand held device comprising:

a. a handle comprising i. a proximal end forming a product dispensing aperture;

ii. a distal end, opposite said proximal end, said distal end forming a cavity for housing a fluid disposed within said handle, wherein said product dispensing aperture and said cavity are in fluid communication via a supply channel;

iii. a peristaltic pump disposed on said handle between said proximal end and said distal end, said peristaltic pump comprising a rotating actuator physically engaged with said supply channel, wherein rotation of rotating actuator directs said fluid from the vicinity of the cavity to said product dispensing aperture via said supply channel;

iv. a flexible barrier positioned between said rotating actuator and said supply channel, and v. wherein said flexible barrier comprises a rotating actuator contacting surface and a supply channel contacting surface, and wherein the flexible barrier comprises more than one layer, wherein the layer forming the rotating actuator contacting surface has a lower coefficient of friction than the layer forming the supply channel contacting surface; and b. a device head, operably connected to said proximal end.

2. The hand held device according to claim 1, wherein said flexible barrier is constructed from a thermoplastic material.

3. The hand held device according to claim 2, wherein said thermoplastic material comprises at least one of polypropylene, polybutylene, polystyrene, polypolytetrafluoroethylene, polybutylene terephthalate, polyethylene terephthalate, polyvinyl chloride, and mixtures thereof.

4. The hand held device according to claim 2, wherein said thermoplastic material comprises polytetrafluoroethylene, polyethylene terephthalate, or a mixture thereof.

5. The hand held device according to claim 1, wherein the barrier comprises polytetrafluoroethylene and glass.

6. The hand held device according to claim 1, wherein said flexible barrier comprises a metal material.

7. The hand held device according to claim 1, wherein said flexible barrier has a thickness between about 0.15 mm and 1.2 mm.

8. The hand held device according to claim 1, wherein said flexible barrier has a static coefficient of friction of less than about 0.3.

9. The hand held device according to claim 1, wherein said flexible barrier has a dynamic coefficient of friction of less than about 0.45.

10. The hand held device according to claim 1, wherein the flexible barrier has a Young's modulus of from about 0.01 GPa to about 200 GPa.

11. The hand held device according to claim 1, wherein said rotating actuator is manually rotatable.

12. The hand held device according to claim 1, further comprising an electric motor that drives said rotating actuator causing said rotating actuator to rotate.

13. A hand held device comprising:

a. a handle comprising i. a proximal end forming a product dispensing aperture;

ii. a distal end, opposite said proximal end, said distal end forming a cavity for housing a fluid disposed within said handle, wherein said product dispensing aperture and said cavity are in fluid communication via a supply channel;

iii. a peristaltic pump disposed on said handle between said proximal end and said distal end, said peristaltic pump comprising a rotating actuator physically engaged with said supply channel, wherein rotation of rotating actuator directs said fluid from the vicinity of the cavity to said product dispensing aperture via said supply channel;

iv. a ratchet mechanism, wherein the ratchet mechanism reduces the rotation of said rotating actuator to a uni-directional rotation; and v. a flexible barrier positioned between said rotating actuator and said supply channel; and b. a device head, operably connected to said proximal end.

* * * * *